US005287571A

United States Patent [19]

Rademacher

[11] Patent Number: 5,287,571

[45] Date of Patent: Feb. 22, 1994

[54] SLEEPING BAG CARRYING AND STORAGE ENCLOSURE WITH AUTOMATIC CLOSURE MEANS

[76] Inventor: Debora L. Rademacher, 348 Sue Rd., Pocatello, Id. 83204

[21] Appl. No.: 957,352

[22] Filed: Oct. 6, 1992

[51] Int. Cl.[5] ..... A47C 29/00; B65D 33/24

[52] U.S. Cl. ..... 5/413; 5/922; 383/4; 383/40; 383/43; 383/85; 383/88; 190/2

[58] Field of Search ..... 383/4, 86, 43, 62, 85, 383/86, 88, 40; 2/69.5; 5/413, 417, 419, 420; 190/2

[56] References Cited

U.S. PATENT DOCUMENTS

| | | | |
|---|---|---|---|
| 831,733 | 9/1906 | Moore | 5/413 X |
| 1,606,107 | 11/1926 | Simms | 383/4 X |
| 2,594,438 | 4/1952 | Howe | 5/413 |
| 3,042,939 | 7/1962 | Schoelkopf, Jr. et al. | 190/2 X |
| 3,446,420 | 5/1969 | Rinecker | 383/89 |
| 4,197,891 | 4/1980 | Comollo | 190/2 X |
| 4,223,056 | 9/1980 | Di Fronzo | 383/4 X |
| 4,587,682 | 5/1986 | Schultz . | |
| 4,604,765 | 8/1986 | Schultz . | |
| 4,671,393 | 6/1987 | Rainey | 383/4 X |
| 4,679,242 | 7/1987 | Brockhaus | 383/86 X |
| 4,967,986 | 11/1990 | Schildkraut . | |
| 4,991,245 | 2/1991 | Franco | 383/4 X |
| 5,048,975 | 9/1991 | Holbrook . | |
| 5,099,530 | 3/1992 | Scott . | |
| 5,172,440 | 12/1992 | Ming | 5/420 X |

FOREIGN PATENT DOCUMENTS

| | | | |
|---|---|---|---|
| 0439420 | 7/1991 | European Pat. Off. | 383/4 |
| 2446622 | 9/1980 | France | 5/419 |
| 2568756 | 2/1986 | France | 190/2 |

*Primary Examiner*—Allan N. Shoap
*Assistant Examiner*—Jes F. Pascua
*Attorney, Agent, or Firm*—Frank J. Dykas; Craig M. Korfanta; Ken J. Pedersen

[57] ABSTRACT

A sleeping bag carrying and storage enclosure (10) is disclosed and has as its two main components a sleeping bag cover (11) and automatic closure system (21). Sleeping bag cover (11) is configured to receive a standard rectangular sleeping bag (1) in its unrolled position and the automatic closure system (21) configured to latch automatically in response to the sleeping bag being rolled up into its normal storage position. The automatic closure system has strategically placed fabric hook and latch fasteners (22) and (23), more commonly known by its brand name VELCRO TM . Here, a pair of first portions of fabric hook and closure fastener (22) are fixed at points on the upper sky facing surface (16) of head panel portion (15), each toward the marginal side edges of the head panel portion. Cooperating second portions of fabric hook and latch fasteners (23) are fixed to the lower ground facing surface (17) at points beginning at a distance from the first pair of fasteners approximately equal to, but slightly less than, the circumference of the sleeping bag when it is in a rolled-up state, such that the fasteners latch automatically as a consequence of the sleeping bag being rolled up.

9 Claims, 6 Drawing Sheets

SLEEPING BAG CARRYING AND STORAGE ENCLOSURE WITH AUTOMATIC CLOSURE MEANS

BACKGROUND OF THE INVENTION

1. Technical Field

This invention generally relates to rolled bedding, and more particularly, to a fabric cover for a sleeping bag which includes an automatic closure system to aid a user in "rolling up" their sleeping bag and storing it in this position.

2. Background Art

There are two common closure means for holding a sleeping bag in a rolled up position. The first is to use a separate duffle type bag, also known as a "stuff" bag because the sleeping bag is quite literally stuffed into the bag and secured there with draw strings. The second closure means commonly used are tie strings which are attached to one end of the sleeping bag. The user rolls the sleeping bag from the opposite end and then ties the strings together around the circumference of the bag. Some sleeping bag manufacturers go as far as attaching a roll cover to the head end of the sleeping bag and building draw strings into the side marginal edges of the roll cover. In this case, the sleeping bag is rolled from the foot end all the way up to the end of the roll cover and the draw strings are then drawn and tied around the circumference of each end of the rolled bag.

The problem with "stuff" bag storage is that sleeping bags which employ heavy multi-layered batting are all but impossible to stuff into the bag. The stuff bags work well with expensive high tech light weight fillings or natural fillings such as duck or goose down since they can be compacted into a small volume. However, most moderately priced sleeping bags, such as those used by children for slumber parties, sleep overs, etc., are designed more for comfort and cost efficiency and consequently use multi-layered batting.

The problem with the tie string system is the requirement of a high level of dexterity to tie the bag in a tight roll. Oftentimes children are simply unable to tie the bag without the aid of an adult. Additionally, even for adults, tieing up a sleeping bag can be relatively time consuming and even prohibitive when time is of the essence. For example, when emergency or military personnel need to move quickly to avoid peril, the extra thirty seconds or so required to tie a sleeping bag could be significant.

SCHULTZ, in his two U.S. Pat. Nos. 4,587,682 and 4,604,756, proposes related solutions which each include a sleeping bag having built in handles and doubling as an article carrying bag. The bags require a relatively high level of dexterity to place them in their storage states.

SCHILKRAUT, U.S. Pat. No. 4,967,986, discloses a carryall for transporting articles to a bathing area in the form of an elongate pouch having fasteners on the inner portion of one end and also on the outer portion of the other end, so that the elongate pouch can be formed into a circular enclosure.

None of the foregoing patents, either individually or in combination, offer a complete solution to the aforementioned problems.

Accordingly, what is needed is an apparatus for quickly and easily securing a sleeping bag in a rolled up storage state which requires very little dexterity to operate, as well as providing a way of storing and carrying personal items, etc.

DISCLOSURE OF INVENTION

The aforementioned needs, as well as others, are satisfied by a sleeping bag carrying and storage enclosure which has a fabric cover for enclosing a standard sleeping bag and a fastener configured to automatically close as a consequence of the sleeping bag being rolled up. The cover includes generally rectangular front and back fabric panels which are attached together along two longer opposing side edges and a shorter foot edge to form a cloth envelope for receiving and holding the sleeping bag. A third fabric panel, the head panel portion, extends coplanarly up from head end of the cover, and is generally simply a part of the back fabric panel.

Cooperating hook and loop fabric fasteners are strategically positioned on the cover to provide the automatic closure feature. First, a pair of first portions of fabric hook and latch fastener are fixed to the sky facing surface of the head panel portion at opposing points along the marginal edges of the head panel. Then, a pair of second portions of cooperating fabric hook and latch fasteners are fixed to the bottom facing surface of the back fabric panel at opposing points lying along lines parallel to the centerline and running through the first portions of fabric hook and latch fasteners and beginning at a distance therefrom which is approximately equal to, but slightly less than, the circumference of the sleeping bag when it is in a rolled up state. The consequence of this configuration is that when the sleeping bag is rolled up, the second portions of the fasteners will come into contact with the first portions and the bag will be latched and held in a rolled up state.

An accessory pocket is built into the head panel portion by attaching an accessory pocket panel to the head panel. The accessory pocket is provided with closure means such as a fabric hook and latch fastener to selectively close and open the pocket for storage and retrieval of accessory items. The pocket is intended to provide a safe place to store personal effects such as a toothbrush, a hair comb, etc., however it could be used to store virtually any small to medium sized item the user desires.

Similarly, a tie string pocket panel is attached to the lower right hand corner of the front panel and is provided with suitable closure means. A pair of string pass-through holes are placed behind the string pocket panel through the front panel. The holes are designed to receive the standard tie strings of a sleeping bag. By tieing the strings together after they are passed through the holes, the sleeping bag and sleeping bag cover are effectively secured together.

Finally, a pair of nylon straps each have their two ends attached to a marginal edge of the ground facing surface of the head panel, one strap secured to one side of the panel and the other strap secured to the other side of the panel. Two halves of a parachute clip are attached at the mid points of each strap, one half of the clip to one strap and the other half of the clip to the other strap. This configuration provides a handle when the two halves of the clip are fastened together, yet insures that the handle won't interfere with the comfort of someone sleeping in the sleeping bag by allowing the user to release the clip and move each handle half to the side of the head panel and out of the way. To fasten the clips together to form the handle, each strap is first looped over its respective side of the sleeping bag roll.

The clip halves are then fastened together on the opposite side of the roll with respect to the points of attachment of the straps. Hence, the straps at least partially encompass the roll to help tightly secure the bag in a rolled up state.

BEST MODE FOR CARRYING OUT INVENTION

Figure 1:
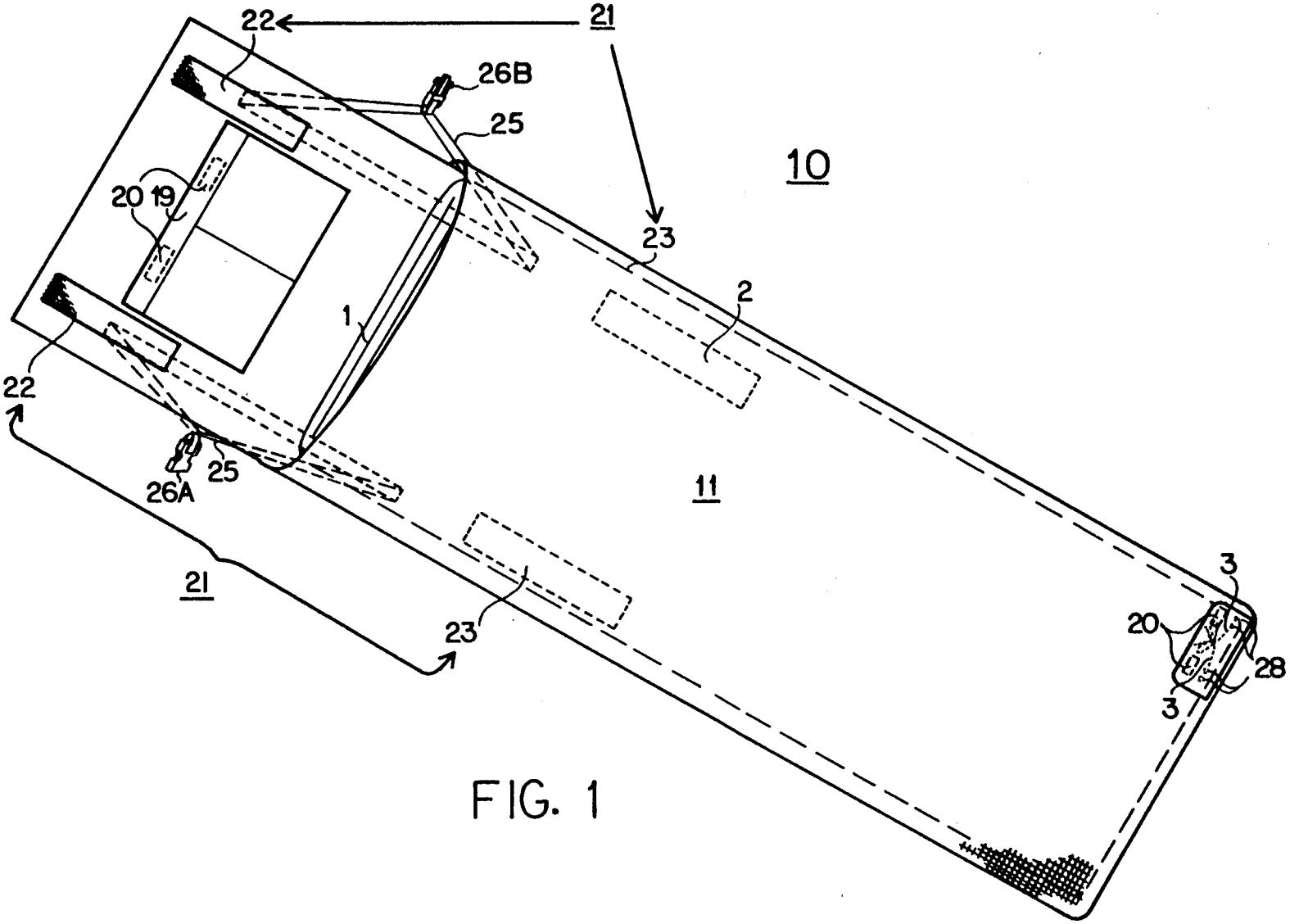
FIG. 1 is a top view of the sleeping bag cover and automatic closure with a sleeping bag therein.

The following detailed description of the sleeping bag carrying and storage enclosure 10 will make continued reference to the attached drawings, FIGS. 1-7. As can be seen in the drawings, sleeping bag carrying and storage enclosure 10, hereinafter simply sleeping bag enclosure 10, has as its two main components a sleeping bag cover 11 and automatic closure means 21. Sleeping bag cover 11 is configured to receive a standard rectangular sleeping bag 1 in its unrolled position and has automatic closure means 21 which latch in response to the sleeping bag being rolled up into its normal storage position. The sleeping bag shown here is of standard elongated rectangular configuration which includes a zipper 2 along its right hand and bottom foot end edges and a pair of tie strings 3 fixed to its bottom right hand corner.

Figure 3:
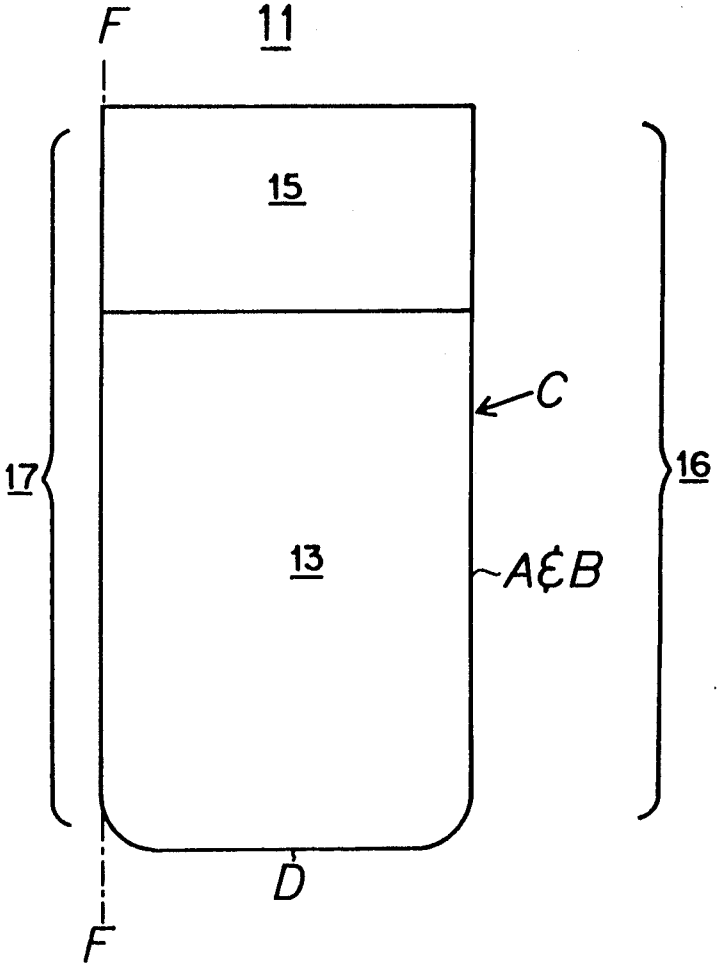
FIG. 3 is a top view of the fabric panel, which forms the sleeping bag cover, in a folded position.
Figure 2:
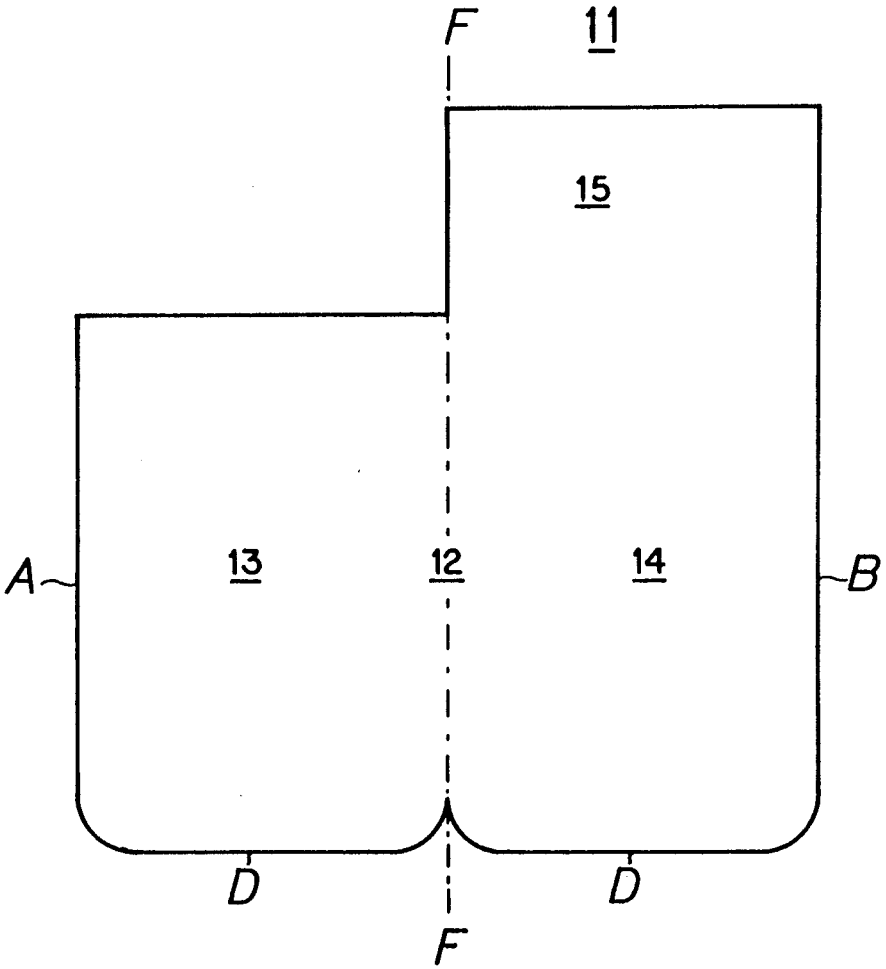
FIG. 2 is a top view of the fabric panel, which forms the sleeping bag cover, in an unfolded position.

Sleeping bag cover 11 is generally manufactured from a single fabric panel 12 of the shape shown in FIG. 2. After being cut into the necessary shape the left half, hereinafter top panel half 13, is folded over along center fold line F—F, onto the right panel half, hereinafter bottom panel half 14, such that edges A and B are aligned. Top panel half 13 is then joined to bottom panel half along the bottom or foot edge D and along edges A and B using a suitable fastener such as sewing or the like, but stopping short of the top or head edge of top panel half 13. FIG. 3 shows the stopping point C, above which a side opening 18 is formed to facilitate insertion and removal of the sleeping bag 1 and entering and exiting from sleeping bag 1 by a user. A head panel portion 15 extends from the upper head end of the bottom panel half 14 and is here actually a single construction, separately designated only for the purposes of illustration and explanation. Also for the purposes of explanation, the upper sky facing surfaces of both top panel half 13 and head panel portion 15 will be designated as upper sky facing surface 16 while the bottom ground facing surface of the bottom panel; half 14 will be designated as bottom or lower ground facing surface 17.

Figure 4:
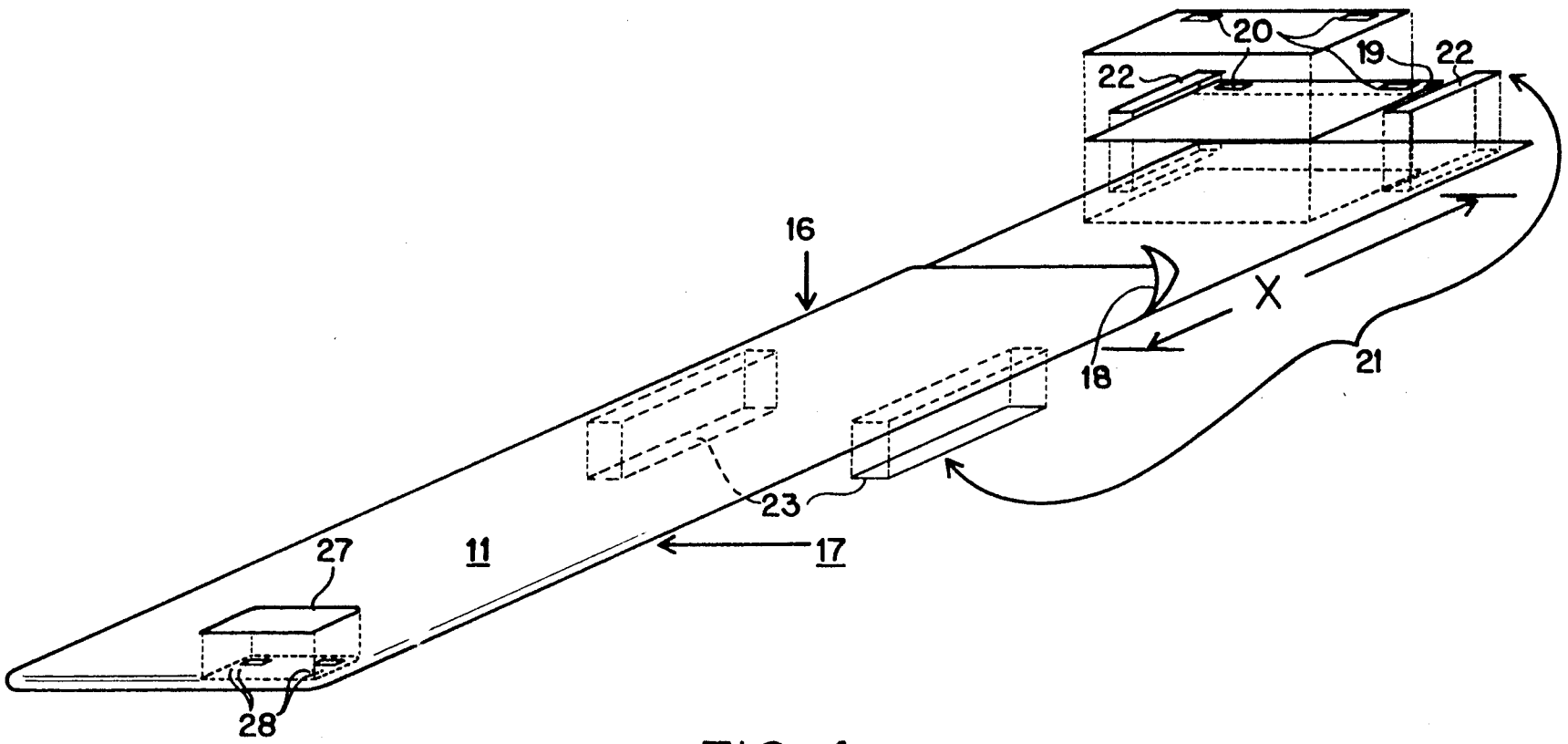
FIG. 4 is a partially exploded three-quarter elevation view of the sleeping bag cover and automatic closure.
Figure 5:
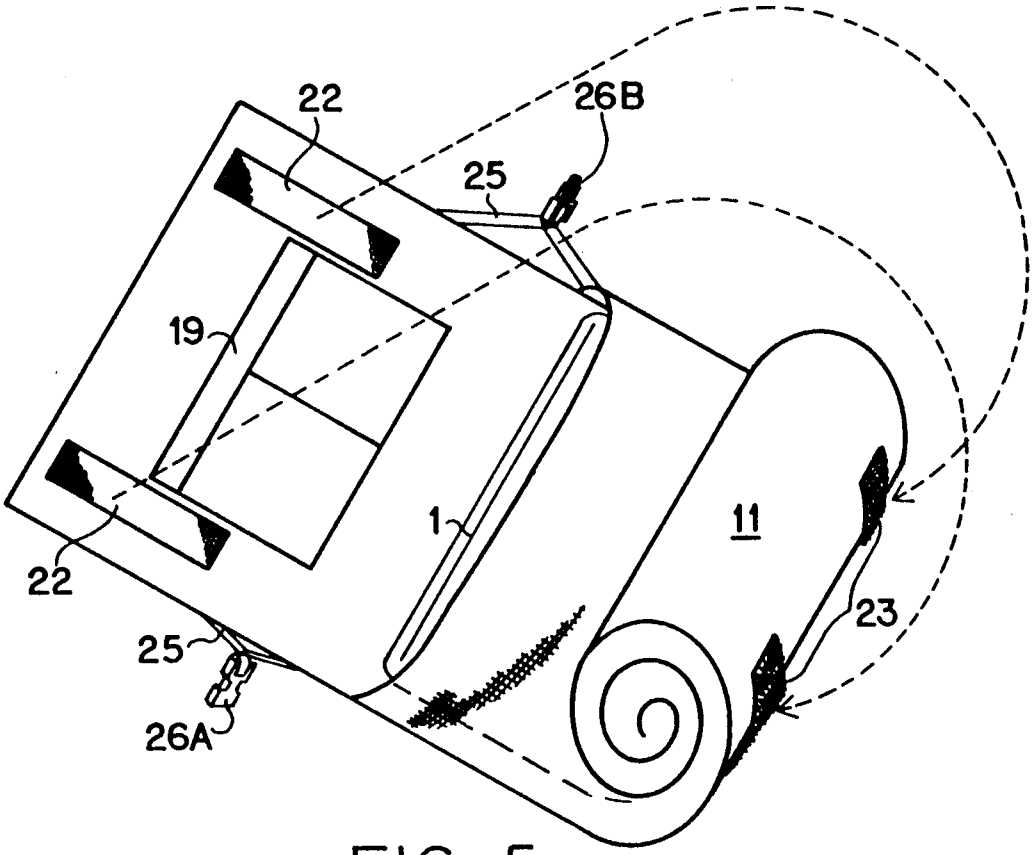
FIG. 5 is a three-quarter elevation view of a partially rolled up sleeping bag in the sleeping bag cover and automatic closure.
Figure 6:
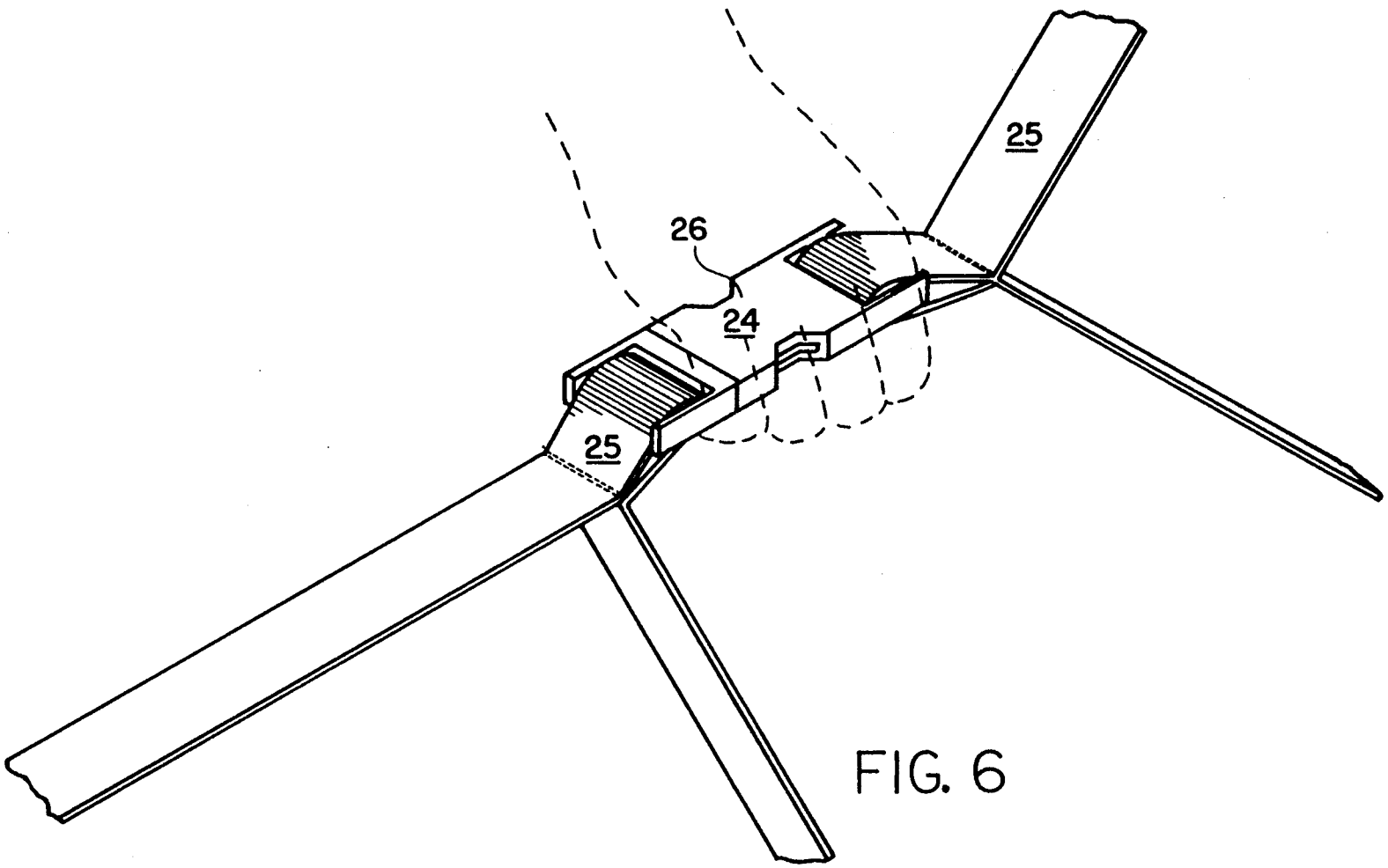
FIG. 6 is a three-quarter elevation view of the parachute clasp which forms a carrying handle for rolled up sleeping bag while in the sleeping bag cover and automatic closure.
Figure 7:
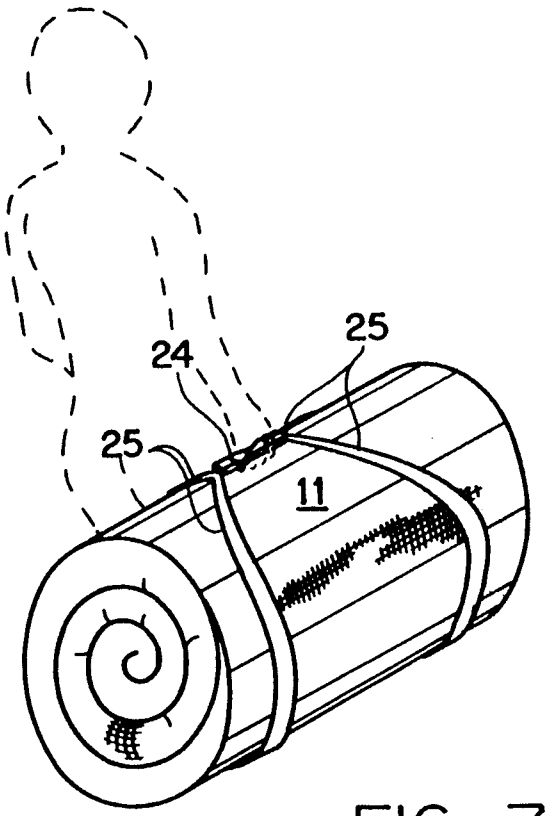
FIG. 7 is a three-quarter elevation view of a rolled up sleeping bag while in the sleeping bag cover and automatic closure.

An automatic closure means 21 is attached to sleeping bag cover 11 to close and latch sleeping bag 1 and sleeping bag cover 11 in a rolled up condition solely in response to the "rolling up"of the sleeping bag. By "automatic closure means", then, is meant means which secure bag cover 11 in a rolled-up condition solely by rolling up the sleeping bag—that is, no other action is required in order to close and secure the bag. In this preferred embodiment, the automatic closure means consists of strategically placed fabric hook and latch fasteners 22 and 23, more commonly known by its brand name VELCRO TM. Here, a pair of first elongated rectangular portions of fabric hook and closure fastener 22 are fixed at points on the upper sky facing surface 16 of head panel portion 15, each toward the marginal side edges of the head panel portion. Cooperating second elongated, rectangular portions of fabric hook and latch fasteners 23 are fixed to the lower ground facing surface 17 the same distance from the side edges of bottom panel half 14, at points along lines parallel to center fold F—F and at a distance beginning at X from their cooperating counterpart 22 which is approximately equal to, but slightly less than the circumference of sleeping bag 1 when its is in a rolled up state. The length of fasteners 22 and 23 provide for overlap of the fasteners. This configuration is best illustrated in FIGS. 4 and 5. The fastener portions 22 and 23 are attached to cover 11 using any suitable fabric fastening means such as sewing or the like.

A carrying handle 24 is fixed to the lower ground facing surface 17 proximate the head panel portion 15 such that it will be on the outside surface of the rolled up sleeping bag 1. Here, carrying handle 24 is made from a pair of nylon straps 25 each having their two ends attached at marginal points on the sides of the sleeping bag cover. Each half of a parachute clip 26 is attached at a midpoint on each strap 25 such that when clip halves 26a and 26b are joined, they, along with straps 25, form an elongated carrying handle 24.

An accessory pocket panel 19 is fixed to the upper sky facing surface 16 between the first portions of fabric hook and closure fastener 22. The panel is attached around a majority of its perimeter, usually its two sides and its bottom edge by sewing or other suitable fabric joining means. A closure means, such as cooperating portions of fabric hook and latch fastener 20 are fixed to the open edge of the resulting accessory pocket so it can be fastened shut to keep overnight items secure.

A pair of tie string receiving holes 28 are positioned in the lower right hand corner of the foot end of sleeping bag cover 11, through which the tie strings of sleeping bag 1 are passed and tied into a knot. This acts to secure sleeping bag 1 inside of sleeping bag enclosure 10. A string pocket panel 27 is attached around a majority of its perimeter, usually its two sides and its bottom edge, to cover string holes 28 and tie strings 3. A closure means, such as cooperating portions of fabric hook and latch fastener 20, are fixed to the open edge of the string pocket such that it can be fastened shut.

Other modifications or variations might include providing a differently shaped sleeping bag cover 11 to receive various shapes of sleeping bags 1, and providing dual carrying straps to enable a user to don the sleeping bag as a backpack, additional pockets for carrying other accessory items, a large pillow pocket for housing and carrying a pillow or even an inflatable bottom panel to provide sleeping comfort. Additional changes might also include the provision of another means for securing the sleeping bag 1 and sleeping bag cover 11 together, such as cooperating portions of fabric hook and latch fastener, one attached to the sleeping bag and one attached to the sleeping bag cover, or even using a foot panel portion instead of a head panel portion, which would result in the sleeping bag being rolled up from the head end rather than the foot end.

In use, sleeping bag enclosure 10 is first laid out on a flat surface such as the floor or the ground and a sleeping bag 1 is inserted into sleeping bag cover 11. The sleeping bag is then secured to the sleeping bag cover by passing tie strings 3 through tie string holes 28 and tying them together in the tie string pocket. To roll the sleeping bag up, one simply starts rolling at the foot end of the bag and rolls toward the head end. As a natural consequence of the rolling, fasteners 23 will come into contact with fasteners 22 and latch the bag in its rolled up state. Then, each nylon strap 25 with half of parachute clip 26 is pulled from the side towards the center of the bag, and clipped together to form handle 24. This way, the bag 1, enclosure 10 and handle 24 become a compact, secure and conveniently carried unit.

While there is shown and described the present preferred embodiment of the invention, it is to be distinctly understood that this invention is not limited thereto but may be variously embodied to practice within the scope of the following claims.

I claim:

1. A sleeping bag carrying and storage enclosure for holding a sleeping bag in both rolled up and unrolled states, in combination with a sleeping bag, which comprises:

a sleeping bag;

elongated enclosure means being configured to receive and hold a sleeping bag in an unrolled state, wherein the elongated enclosure is formed from a fabric panel being folded along a centerline and sewn along two edges to form a generally rectangular enclosure having shorter foot and head ends and longer sides, the folded panel further defining a bottom panel half including a ground facing surface, and a head panel portion extending coplanarly from the bottom panel half at the shorter head end, the head panel portion including both a ground facing surface and a sky facing surface, and the shorter head end being open for receiving the sleeping bag into the enclosure;

a string pocket panel, having a perimeter edge defining its shape and being attached around a majority of its perimeter, but unattached along one edge, to the enclosure proximate the enclosure's foot end to form a string pocket;

the enclosure having a pair of string holes through it at points proximate the string pocket panel for receiving sleeping bag tie strings and holding them within the string pocket and securing the sleeping bag to the enclosure; and automatic closure means, including a latch being positioned on the enclosure means and configured to close in response to the sleeping bag being rolled up, for holding the sleeping bag in a rolled up state.

2. The sleeping bag carrying and storage enclosure of claim 1 wherein the elongated enclosure has a fabric panel being folded along a centerline and sewn along two edges to form a generally rectangular enclosure having shorter foot and head ends and longer sides, the folded panel further defining a bottom panel half including a ground facing surface, and a head panel portion extending coplanarly from the bottom panel half at the shorter head end, the head panel portion including both a ground facing surface and a sky facing surface, and the shorter head end being open for receiving the sleeping bag into the enclosure.

3. The sleeping bag carrying and storage enclosure of claim 2 wherein the automatic closure means comprises:

a first portion of fabric hook and latch fastener being fixed to the sky facing surface of the head panel portion; and a second portion of fabric hook and latch fastener being configured to latch with the first portion of fabric hook and latch fastener and being fixed to the ground facing surface of the bottom panel half at a point lying along a line parallel to the centerline and running through the first portion of fabric hook and latch fastener and beginning at a distance therefrom which is approximately equal to, but slightly less than, the circumference of the sleeping bag when it is in a rolled up state.

4. The sleeping bag carrying and storage enclosure of claim 2 further comprising handle means being attached to the ground surface of the bottom panel half between the sides proximate the head end.

5. The sleeping bag carrying and storage enclosure of claim 2 further comprising an accessory pocket panel, having a perimeter edge defining its shape and being attached around a majority of its perimeter, but unattached along one edge, to the sky facing surface of the head panel portion to form a pocket thereon.

6. The sleeping bag carrying and storage enclosure of claim 5 further comprising pocket closure means for closing the accessory pocket to prevent items for falling out.

7. The sleeping bag carrying and storage enclosure claim 2 further comprising:

a string pocket panel being attached around a majority of its perimeter, but unattached along one edge, to the enclosure proximate the enclosure's foot end to form a string pocket; and the enclosure having a pair of string holes through it at points proximate the string pocket panel for receiving sleeping bag tie strings and holding them within the string pocket and securing the sleeping bag to the enclosure.

8. The sleeping bag carrying and storage enclosure of claim 7 further comprising an accessory pocket panel being attached around a majority of its perimeter, but unattached along one edge, to the sky facing surface of the head panel portion to form a pocket thereon.

9. The sleeping bag carrying and storage enclosure of claim 8 further comprising pocket closure means for closing the accessory pocket to prevent items from falling out.

* * * * *